United States Patent [19]

Grantham

[11] 4,059,258

[45] Nov. 22, 1977

[54] DOUBLE FOLD AUTOMATIC FOLDING APPARATUS

[76] Inventor: Frederick W. Grantham, 12055 Goshen Ave., Los Angeles, Calif. 90066

[21] Appl. No.: 593,206

[22] Filed: July 7, 1975

[51] Int. Cl.[2] ..... B65H 45/18

[52] U.S. Cl. ..... 270/67; 270/80; 271/64

[58] Field of Search ..... 270/67, 62, 80–85; 271/64; 93/93 M, 93 K

[56] References Cited

U.S. PATENT DOCUMENTS

| | | | |
|---|---|---|---|
| 2,871,010 | 1/1959 | Likens | 270/81 |
| 2,974,948 | 3/1961 | Malott | 270/81 |
| 3,472,506 | 10/1969 | Rabinow | 271/64 |
| 3,475,018 | 10/1969 | Mattka | 270/67 |
| 3,749,393 | 7/1973 | Wolfelsperger | 270/67 |

*Primary Examiner*—E. H. Eickholt

*Assistant Examiner*—A. Heinz

*Attorney, Agent, or Firm*—Henry M. Bissell

[57] ABSTRACT

A double fold automatic folding apparatus for selectively developing a second fold in a previously folded article. The apparatus includes a reversible roller which, in one direction of rotation, serves to bypass the second folder and, in an opposite direction of rotation, operates to divert a previously folded article into a position for engagement by the second folder. After the article is diverted to the second folder, the roller is further operable so that the double folded article is drawn out of the second folder toward a conveyor which transports the double folded article to an exit portion of the automatic folding apparatus. Various elements may be optionally provided to assist in diverting the article toward engagement with the second folder and in rendering the operation of the apparatus more effective.

20 Claims, 21 Drawing Figures

DOUBLE FOLD AUTOMATIC FOLDING APPARATUS

BACKGROUND OF THE INVENTION

1. Field of the Invention

The present invention relates to the field of automatic material folding machines and, more particularly, to laundry-related machines for making multiple folds on flat cloth articles such as towels, diapers and pillow cases.

2. Description of the Prior Art

A major cost associated with institutional, industrial and commercial laundering is folding of the laundered articles so they may be easily handled, neatly stored and rapidly dispensed. Manual folding, when large quantities of the laundered articles are involved, as is often the situation, is very time-consuming and thus very expensive. There is, consequently, a substantial need for machines for automatically folding the laundered articles in a continuous flow manner. One such type apparatus is disclosed by the applicant in his prior U.S. Pat. No. 3,462,138. In accordance with such patent, workable and widely-accepted machines have been built and sold by applicant, for example, the "Iron Woman" automatic folding machine for small articles which will automatically make a center fold or a French fold and then a cross fold, and which is adaptable for use with laundered articles having sizes up to about 2 feet by 4 feet. These machines are particularly useful when large quantities of a single type and single-sized article, for example, towels, napkins and diapers, are involved. Unfolded laundered items are continuously fed into one end of the machine, and folded items are continuously dispensed or delivered from the other end of the machine.

There is, however, often a need or desire for an additional cross fold to be made in the articles, either for appearance or to further reduce the size of the folded article. Often a single cross fold, as accomplished by the present machine, is required for articles of a given type for one customer and an added cross fold is required for similar articles to be supplied to another customer.

Presently, provision for such an additional cross fold or provision for such an additional cross fold on an optional basis does not exist. Therefore, fully automatic folding is sometimes not available, and the benefits of the existing machines are somewhat diminished, the final folding necessarily having to be done manually.

Not only is it very desirable that new machines have such an optional additional cross fold provision as a feature thereof, but also that means be provided for modifying many of the existing machines, which are in use throughout the world, to make provision for such an added cross fold.

SUMMARY OF THE INVENTION

Apparatus, in accordance with the invention and in combination with a machine capable of performing at least two sequential operations on generally flat articles, comprises generally an axially rotatable directing roller disposed intermediate the two operations and in a position to intercept articles as they emerge from the first operation, drive means for rotating the roller in a first direction to deflect the articles away from the second operation for bypassing of that operation and in a second direction for deflecting the articles towards the second operation, and control means for controlling the drive means to selectively cause rotation of the roller in either of the two directions according to whether the second operation is to be bypassed or is to be performed. Movable ramp means are provided for enhancing directing action of the roller. Ramp control means selectively move the ramp between a first position, to assist the roller in causing bypassing of the second operation, and a second position, to assist the roller in causing the articles to be diverted towards the second operation. Means may also be provided for pushing leading portions of the articles towards the second operation to further assist the directing action of the roller and the ramp means.

More particularly, and in combination with an article folding machine having an article delivering means and an article receiving means, added folding means are provided for making an additional fold in articles previously folded by the machine. Directing apparatus is provided for diverting articles from the delivering means to the added folding means. The added folding means comprises a movable article folding knife having a blade which is caused to be moved into contact with portions of the articles, thereby causing the articles to fold back upon themselves. The directing means comprises a roller disposed intermediate the delivering means and receiving means and the added folding means. The roller is caused to be rotated in a first direction to divert articles from the delivering means to the added folding means and then in a second direction to pick up additionally folded articles from the article folding knife and advance them to the receiving means.

A movable ramp is provided to enhance the diverting action of the roller. When the ramp is moved into a bypass position and with the roller caused to be rotated in the second direction, articles are advanced directly across the ramp and roller from the delivering means to the receiving means. With the ramp lowered, and the roller caused to be rotated in the first direction, articles are deflected towards the added folding means. Control means are provided for controlling the direction of rotation of the roller and movement of the ramp in response to both a prior folding operation in the machine and to movement of an article which is to receive the additional folding.

An additional movable blade may be provided which, when selectively actuated, contacts leading portions of the articles, thereby pushing them past the roller and towards the added folding means.

In one variation, the roller is caused to rotate always in a direction advancing articles from the delivering means or added folding means to the receiving means. A second ramp, selectively movable between a retracted position and a diverting position between the roller and the delivering means, is provided for causing diverting of the articles from the delivering means towards the added folding means. The above-mentioned second movable blade may be used with this variation to enhance diverting of the articles to the added folding means.

In another variation which does not employ movable ramps, two rollers are employed, one roller being always rotated in a direction to advance articles from either the delivering means or the added folding means to the receiving means, and the other being reversibly rotatable to cause bypassing of the added folding means or to direct articles first to the added folding means and then from the added folding means, after they have received an additional fold, to the receiving means.

Means are thereby provided for selectively making an additional fold in articles received from a machine wherein the articles have received a previous fold.

BRIEF DESCRIPTION OF THE DRAWINGS

A better understanding of the present invention may be had from a consideration of the following detailed description, taken in conjunction with the accompanying drawings in which.

DESCRIPTION OF THE PREFERRED EMBODIMENT

Figure 1:
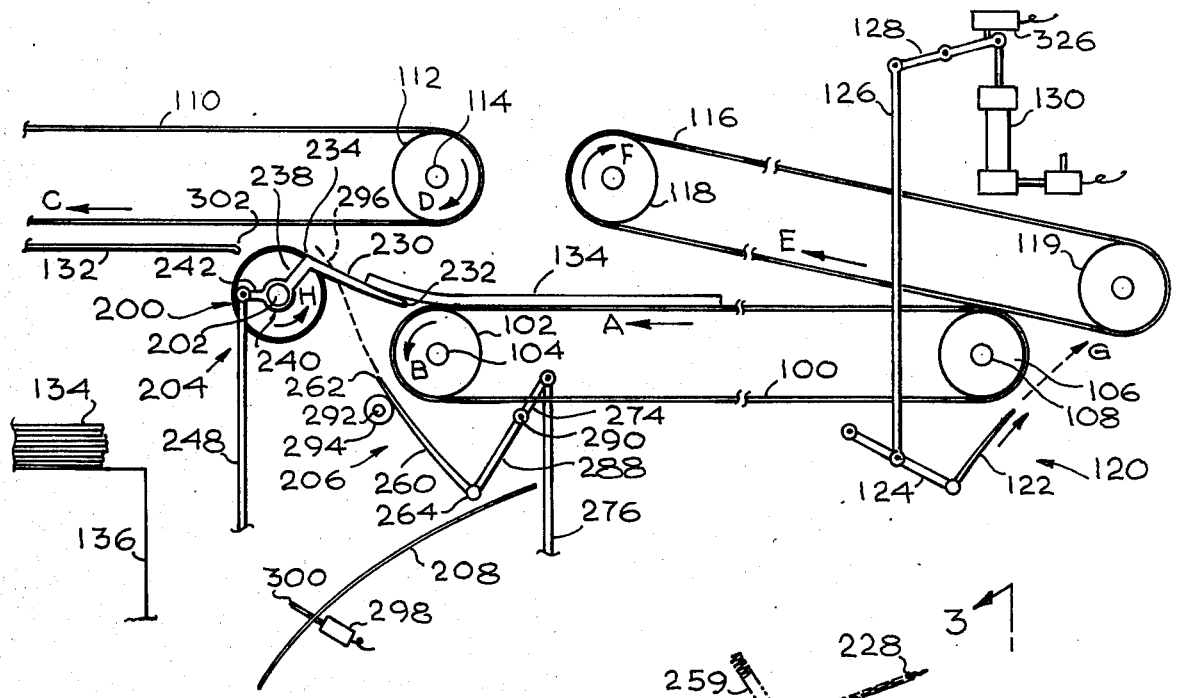
FIG. 1 is a vertical sectional view of the added cross folder shown connected to an existing folding machine with the added reversible roller and ramp in a bypass condition.

FIG. 1 illustrates the added cross folder in combination with a discharge portion of a folding machine, for example, an "Iron Woman" model, small article folder. Features of the existing apparatus are identified by reference numbers in the 100 series, and features of the added cross folder are identified by reference number 200 and subsequent.

Described generally, the existing portion comprises a continuous delivery belt 100 (which may be known as a lower horizontal belt or a lower transfer belt), the upper portion of which is driven in the direction of arrow A by a rear or first drive roller 102 fixed to a first drive shaft 104 which is caused, by means not shown, to be rotated in the direction of arrow B, or counterclockwise as viewed in FIG. 1. The forward or receiving end of the belt 100 is supported by a forward idler roller 106 mounted on a forward shaft 108. A continuous receiving belt 110 (which may be known as a flipper exit belt) is positioned rearwardly, and at an elevation just above, the delivery belt 100. Lower portions of the belt 110 are driven in the direction of arrow C by a second drive roller 112, which is positioned above the first roller 102, and which is fixed to a second drive shaft 114 caused to rotate (by means not shown) in the direction of arrow D, or in a clockwise direction as viewed in FIG. 1. The rear portion of the receiving belt 110 is mounted on a rear idler roller not shown. A third continuous belt 116, positioned generally above the delivery belt 100, assists delivery of articles by such delivery belt, and has a lower portion driven in the direction shown by arrow E by a third drive roller 118 rotated in the direction of arrow F, or clockwise, as viewed in FIG. 1. The belt 116 is supported at a forward end by a roller 119.

A first article folding knife 120 is positioned adjacent to, and under, forward portions of the delivery belt 100, and includes a movable blade 122 which is driven, through a first lever arm 124, a connecting rod 126 and a second lever arm 128, by a pneumatic cylinder 130 so as to move upwardly and forwardly in the direction shown by arrow G for making a cross fold on articles delivered to the delivery belt 100 from other portions (not shown) of the existing apparatus.

A pair of downwardly pivoting plates 132, referred to as flippers, operate to drop folded articles 134 onto a table or cart 136 (or an additional conveyor belt) positioned below the flippers. As more particularly described below, the flippers 132 are slightly modified to accommodate the added cross fold apparatus.

Figure 2:
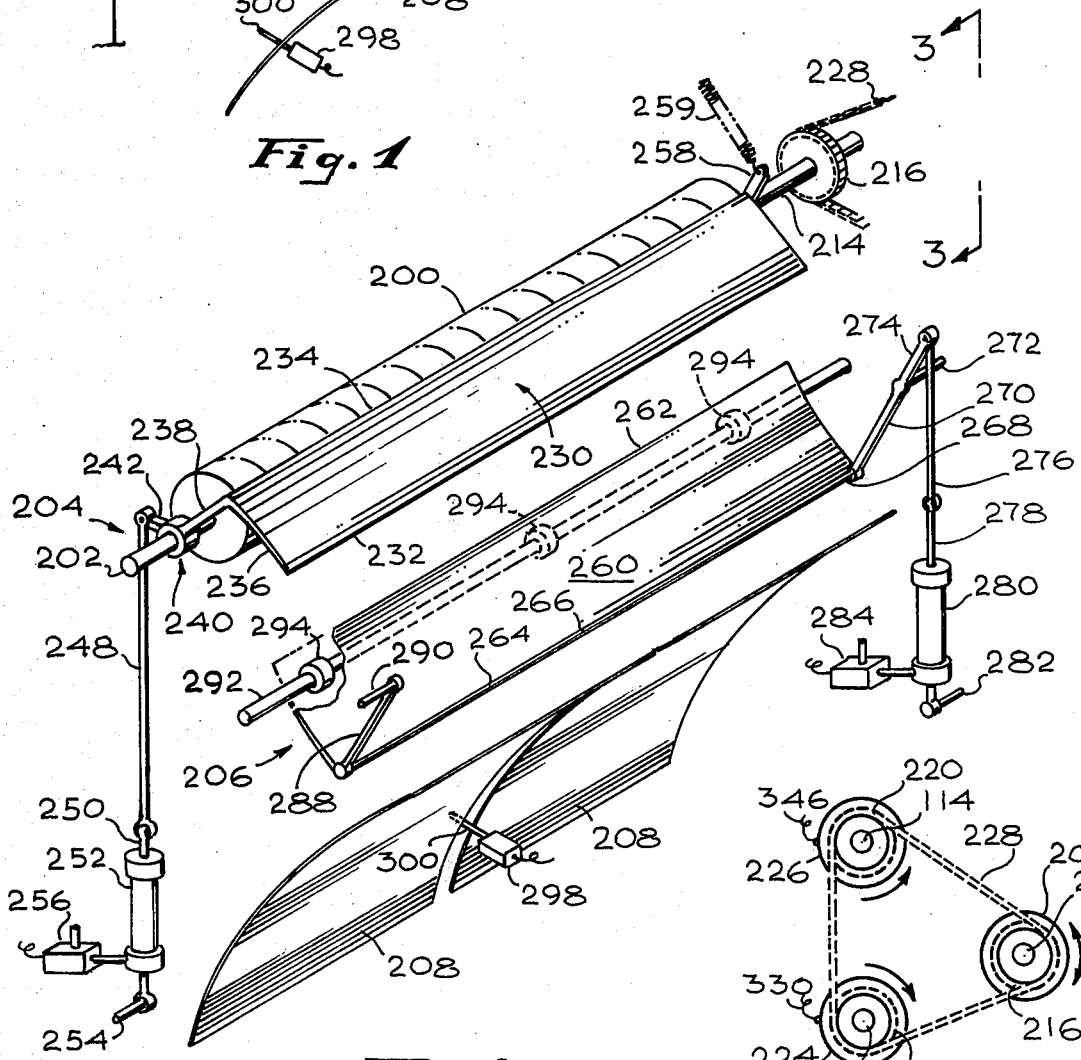
FIG. 2 is a perspective view of the added cross folder showing the added reversible roller, the ramp, the added folding knife, the added glideway, and portions of the controls.

Referring to FIGS. 1 and 2, the cross fold apparatus, which is added to form a double fold, automatic folding apparatus, comprises generally an added, reversible roller 200 fixed to a drive shaft 202, a ramp assembly 204 pivotally mounted on end portions of the shaft 202, an added cross fold knife assembly 206, and a pair of added glideways 208.

Figure 5:
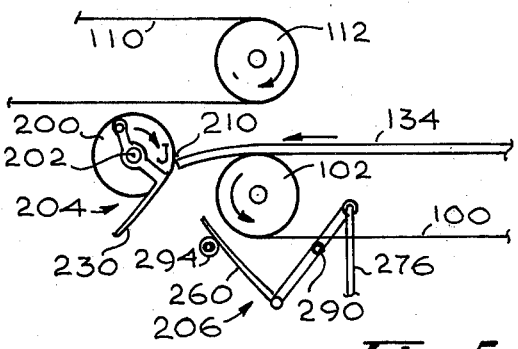
FIG. 5 is a vertical sectional view showing the ramp in a retracted condition and the added reversible roller rotating clockwise, and showing the leading edge of the advancing article being deflected downwardly for an added cross fold.

More particularly described, the added roller 200 is positioned parallel to, and slightly rearwardly of, the first roller 102 (for example, being centered about 3⅝ inches or 9.2 cm therefrom). The axis of the drive shaft 202 is above the axis of the shaft 104, at about the elevation of the upper surface of the roller 102 such that, as seen in FIG. 5, a leading edge 210 of an article 134 being delivered by the delivery belt 100 contacts the periphery of the roller 200 generally radially. The diameter of the roller 200 is about that of the roller 102 and the roller 112 (and may be about 2 inches or 5.1 cm; its length may be about 17¾ inches or 33.4 cm).

Figure 3:
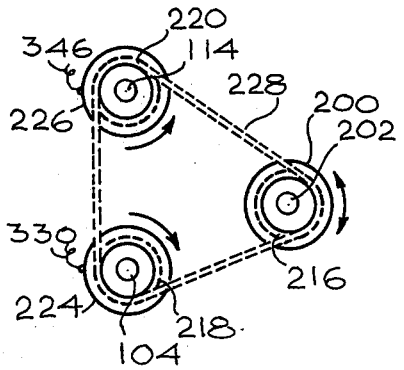
FIG. 3 is a vertical view along line 3—3 of FIG. 2, showing the drive mechanism for the added reversible roller.

Ends of the drive shaft 202 project beyond the ends of the added roller 200 for journaling in vertical walls (not shown) of the machine. Beyond such a wall, on a first shaft end 214 is fixed a first, roller drive sprocket 216. As shown in FIG. 3, similar sprockets 218 and 220 are mounted upon outwardly projecting ends of the shafts 104 and 114 respectively. A first electric clutch 224 enables engagement of the sprocket 218 with the shaft 104 and a second electric clutch 226 enables engagement of the sprocket 220 with the shaft 114. A continuous loop drive chain 228 interconnects all three sprockets 216, 218 and 220, and causes rotation, as more particularly described below, of the added roller 200 in either a first (counterclockwise) or a second (clockwise) direction, as viewed in FIG. 1 (thus, in directions opposite those shown in FIG. 3) from either the first drive shaft 104 or the second drive shaft 114 respectively.

Bonded, or otherwise attached, to the surface of the roller 200 may be a non-slip covering (not shown) to provide a friction drive on articles passing thereover or thereby.

The ramp assembly 204 comprises an elongate, thin rigid ramp plate 230 having a length substantially equal to that of the roller 200 and having a width, as shown in FIG. 1, to generally bridge the region or gap between upper sufaces of the added roller 200 and the first roller 102 so that an outer or projecting edge 232 is adjacent the surface of such first roller. Attached at right angles to a rear edge 234 of the plate 230, at a first (left-hand, as seen in FIG. 2) end 236, is a first arm 238 of a crank 240 which is pivotally mounted on the shaft 202 adjacent to an end of the roller 200. For pivoting of the plate 230, a second arm 242 of the crank 240 projects generally rearwardly. Pivotally attached to the end of the arm 242 is the upper end of a generally vertical push rod 248, which has a lower end connected to a shaft 250 of a pneumatic actuating cylinder 252, which is in turn pivotally mounted by a pin 254 to the machine wall. Operation of the cylinder 252 is electrically controlled by a connected control valve 256. The other end of the ramp plate 230 is pivotally connected to the shaft 202, at the end 214, by an arm 258, which is parallel to the arm 238. A tension spring 259, connected between the machine wall and the arm 258, biases the plate 230 towards the bypass configuration illustrated in FIG. 1.

When installed on the shaft 202, the rear edge 234 of the ramp plate is closely-adjacent to the surface of the roller, and the plate is generally tangent to such surface.

The added folding knife assembly 206 includes a curved blade 260, having an elongate, article contacting upper edge 262, which is formed of a stiff sheetmetal, for example, a stainless steel sheet. The blade 260 is curved to be slightly concave downwardly and rearwardly when the blade is in a retracted condition. A rod 264 is pivotally connected along a lower edge 266 of the blade 260. Fixed to a first end 268 of the rod 264 is one end of an elongate arm 270 which is pivotally connected near its other end by a pin 272, to the machine wall. Pivotally attached to an upper projecting portion 274 of the arm 270 is a downwardly-directed push rod 276, which is connected at a lower end to a shaft 278 of a pneumatic cylinder 280. The lower end of the cylinder is pivotally connected to the machine wall by a pin 282. Actuation of the cylinder 280 is by means of an electric control valve 284 connected thereto. A second arm 288, parallel to the arm 270, is fixed to the opposite (left-hand, as seen in FIG. 2) end of the rod 264. The upper end of the arm 288 is pivotally attached to the machine wall by a pin 290.

Positioned to be adjacent the blade 260, near the article contacting edge 262, when the blade is in a retracted condition (FIG. 1), is an elongate guide shaft 292, ends of which are mounted in the machine walls. Mounted on the shaft 292 are a plurality of spaced blade guide wheels or rollers 294. As seen in FIG. 1, in the normal or retracted condition, the arms 270 and 288 and the blade 260 form a "V" which is positioned generally just below the first roller 102. The relationship between positioning of the pivot pins 272 and 290, the length of the arms 270 and 288, and the positioning of the guide shaft 292, are such that when the added folding knife assembly 206 is actuated to advance the blade edge 262 thereof, such edge follows a slightly-curved path, identified by the dashed line 296, directed upwardly and rearwardly between the first roller 102 and the added roller 200. The path 196 is tangential to the periphery of the added roller and toward the under portion of the receiving belt 110.

The added pair or glideways 208 comprises two curved sheets of smoothly-polished metal, for example stainless steel, which are concave upwardly and rearwardly. Positioning of the glideways 208, which serve to guide portions of an article receiving an added cross fold, is generally below the roller 102, with portions thereof extending rearwardly to be under the added roller 200.

A microswitch 298 for controlling operation of the added cross folder is mounted just forwardly of the glideways 208, an elongate article contacting rod 300 thereof extending upwardly and rearwardly between adjacent edges of such glideways.

Forward portions of the flippers 132 are removed so that forward edges 302 thereof are closely-adjacent to the rearward portions of the roller 200.

OPERATION OF THE ADDED CROSS FOLDER

First, the added cross folder may be bypassed as shown in FIG. 1, the ramp assembly 204 then being in a "bypass" or upward condition, and the roller 200 then rotating in unison with the first roller 102 to advance articles 134 from the delivery belt 100 across the ramp plate 230 to the receiving belt 110 and flippers 132, and thence to the table 136.

Figure 9:
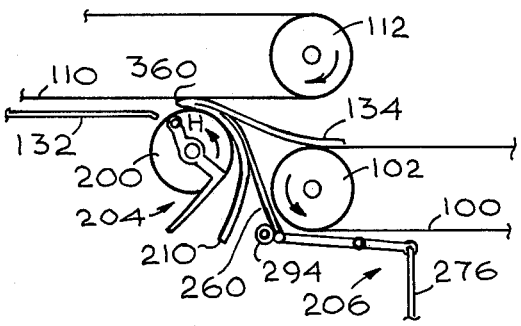
FIG. 9 is a vertical sectional view of the condition of FIG. 8, showing the new fold of the article being picked up by the added reversible roller and the receiving belt, and showing the added knife retracting.
Figure 6:
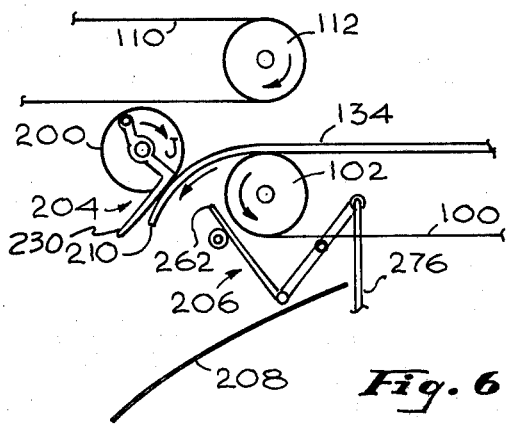
FIG. 6 is a vertical view for the condition of FIG. 4, showing continued downward deflection of the article.
Figure 10:
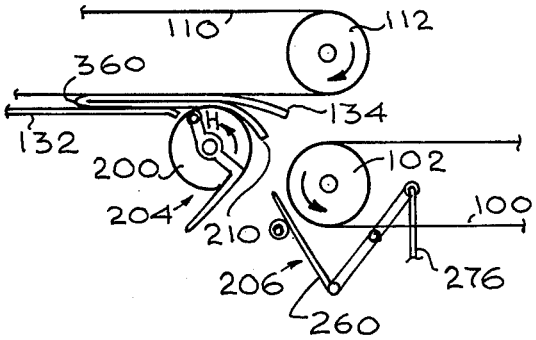
FIG. 10 is a vertical sectional view of the condition of FIG. 9, showing the folded article almost completely delivered by the added reversible roller and receiving belt, and showing the added knife fully retracted.
Figure 7:
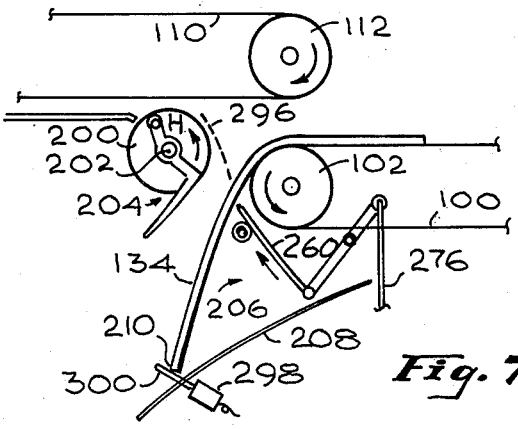
FIG. 7 is a vertical sectional view for the condition of FIG. 4, showing the leading edge of the article contacting the microswitch which actuates the added folding blade and which reverses the direction of rotation of the added reversible roller.
Figure 11:
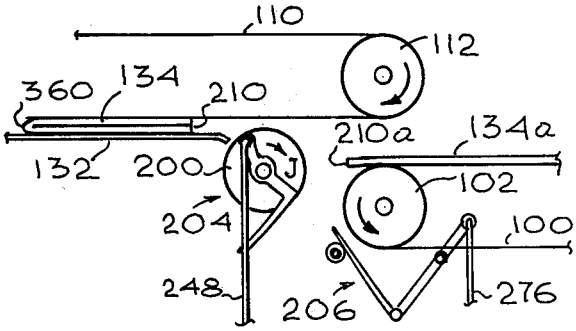
FIG. 11 is a vertical sectional view, showing the folded article fully delivered to the flippers, and with the direction of rotation of the added roller reversed in readiness for deflecting and advancing a next article.
Figure 8:
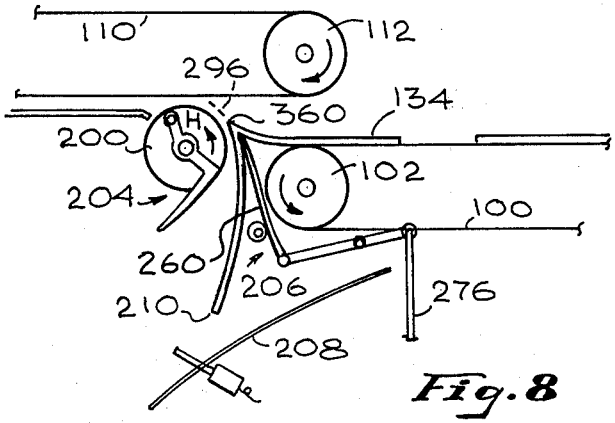
FIG. 8 is a vertical sectional view showing the added folding knife advancing upwardly and lifting a central portion of an article receiving an added cross fold toward the now counterclockwise rotating added roller.

Stated briefly, when an added cross fold is to be made, the ramp assembly 204 is first retracted and the roller 200 is caused to rotate in a clockwise direction so that the leading edge 210 of the article 134 being advanced by the delivery belt 100 is directed downwardly for cross folding (FIGS. 5 and 6). After a predetermined portion of the article 134 has been diverted downwardly, the second folding knife assembly 206 is actuated and rotation of the roller 200 is reversed to counterclockwise. Actuation of the knife assembly 206 causes the blade 260 to move upwardly along the path 296 (FIG. 7), carrying a centrally-contacted portion of the article 134 along with it, thereby starting the added cross fold (FIG. 8). Continued travel of the blade 260 pushes the cross folded portion of the article 134 into contact with the counterclockwise rotating roller 200 and the rearward traveling portion of the receiving belt 110 (FIG. 9). As the roller 200 and the belt 110 pull the article 134 rearwardly onto the flippers 132, the blade 260 is retracted (FIG. 10). When the blade is fully retracted and the article is past the roller 200, the roller 200 is again reversed to clockwise rotation and the apparatus is ready to receive a next article for added cross folding (FIG. 11).

Figure 4:
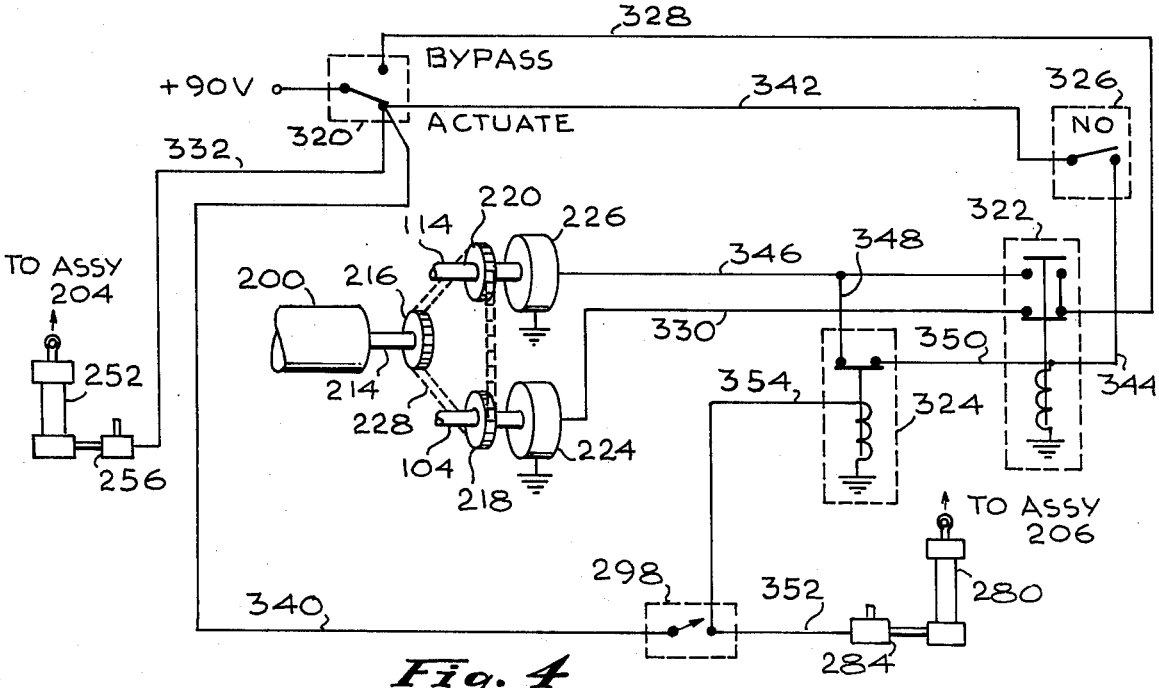
FIG. 4 is an electrical schematic of the added cross folder control system.

Sequencing of these various steps is automatically accomplished by electric circuitry, illustrated in FIG. 4, which comprises generally a mode selector switch 320, a clutch relay 322, a latching relay 324 and a normally-open microswitch 326 actuated by the arm 128 of the first folding knife 120 (FIG. 1).

Placing the switch 320 in the bypass position directs voltage to the clutch 224, via lines 328 and 330 and through normally-closed contacts of the clutch relay 322, thereby causing the roller 200 to be rotated in a counterclockwise direction (the direction of arrow H, FIG. 1) by the sprocket 218. Pneumatic pressure to the pneumatic cylinders 252 and 280 maintains the ramp assembly 204 in the up, or bypass, condition and the knife assembly 206 in the retracted position. Articles 134 from the delivery belt 100 are advanced directly across the ramp plate 230 and roller 200 to the flippers 132.

Movement of the switch 320 to the actuate, or double fold, position directly actuates, via a line 332, the control valve 256 of the pneumatic cylinder 252, thereby causing retraction of the ramp plate 230 to the lowered condition (for example, FIGS. 5 and 6). Voltage is simultaneously directed to the switches 298 and 326, via lines 340 and 342 respectively. When the first cross fold knife 120 is actuated to make a first cross fold, the switch 326 is momentarily closed by the movement of the knife arm 128. This momentary closing actuates the relay 322, through lines 342 and 344, thereby opening the normally-closed contacts in series with the lines 328 and 330 and disengaging the clutch 224. The clutch 226 is simultaneously engaged through lines 328 and 346 and the now closed, normally-open contacts of the relay 322. In this manner, the direction of rotation of the roller 200 is reversed to clockwise rotation (direction of arrow J, FIGS. 5 and 6). The relay 322 is latched closed, to maintain clockwise rotation of the roller 200 by the sprocket 220, through lines 348 and 350 and the normally-closed contacts of the relay 324.

The leading edge 210 of the article 134 is deflected and driven downwardly into the added cross folder by the clockwise rotation of the roller 200 and is pushed or advanced in such direction by the rearwardly moving portion of the delivery belt 100. The leading edge 210 slides down the glideways 208 until it contacts the projecting rod 300 and closes the switch 298 (FIG. 7). Closing of the switch 298 directly energizes, via the line 352, both the control valve 284, connected to the added knife pneumatic cylinder 282, and the relay 324, via the line 354, the latter causing unlatching of the relay 322 and reversing of the roller 200 to counterclockwise rotation (the clutch 226 being disengaged and the clutch 224 being reengaged).

Advancement of the blade 260 by the cylinder 282, upwardly and rearwardly along the path 296, starts the added cross fold and lifts a newly-folded edge 360 of the article 134 into contact with the counterclockwise rotating roller 200 and the rearwardly moving portion of the receiving belt 110 (FIGS. 8 and 9). Counterclockwise rotation of the roller 200 continues to advance the newly cross-folded article 134 onto the flippers 132 as the knife blade 260 is retracted to its normal retracted position (FIG. 10) by the cylinder 282, after voltage is removed from the control valve 284 by return of the rod 300 to its normal position.

First cross folding by the knife 120 of a next article 134*a* reenergizes the relay 322 (which is again latched through the relay 324), thereby reversing rotation of the roller 200 to clockwise rotation in readiness to divert such next article downwardly for an added cross fold (FIG. 11)

VARIATION OF FIGS. 12–15

As illustrated in FIGS. 12–15, a driver assembly 370 may be provided to assist the roller 200 and the ramp plate 230 in diverting articles 134 downwardly into the added cross folder. Such driver assembly may be beneficially employed when the articles to receive an added cross fold are relatively stiff and may not be diverted effectively by the roller 200 or are relatively light and may tend to slide relative to the delivery belt when the roller is contacted.

Figure 13:
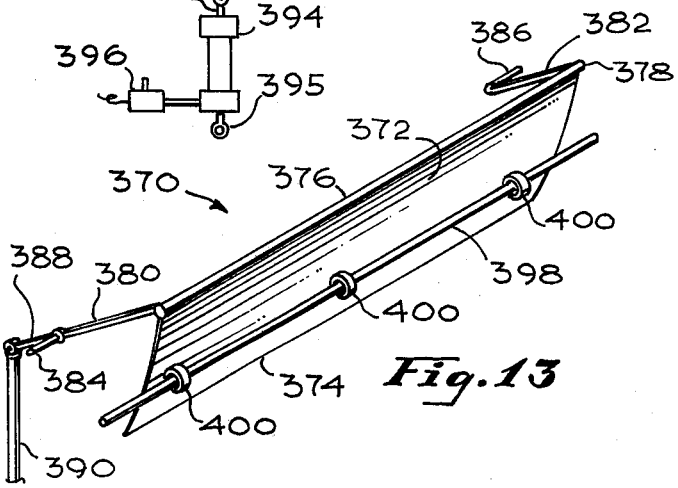
FIG. 13 is a perspective view of the article driver of FIG. 12.

The driver assembly 370, which is similar to the previously described knife assembly 206, comprises, as best seen in FIG. 13, a slightly curved elongate blade 372 having a lower article contacting edge 374 and an upper edge 376. Pivotally attached along the upper edge 376 is a rod 378, to the left-hand end (as seen in FIG. 13) of which is affixed an actuating arm 380. An arm 382 is fixed, in parallel relationship with the arm 380, to the right-hand end of the rod 378. The arm 380 is pivotally mounted to the machine wall by a pin 384; a similar pin 386 pivotally mounts the arm 382 to the machine wall. To a projecting portion 388 of the arm 380 is pivotally attached the upper end of a generally vertical push rod 390, the lower end of which is connected to a shaft 392 of a pneumatic cylinder 394, which is in turn pivotally mounted to the machine wall by a pin 395. Connected to the cylinder 394 is a control valve 396.

A shaft 398, ends of which are mounted to the machine wall, is positioned just forward of lower portions of the blade 372. A plurality of spaced rollers 400, mounted on the shaft 398, guide the blade 372 along a path indicated by dashed lines and the reference number 402 (FIG. 12), and which extends rearwardly between the rollers 102 and 112 and downwardly between the rollers 102 and 200.

Figure 12:
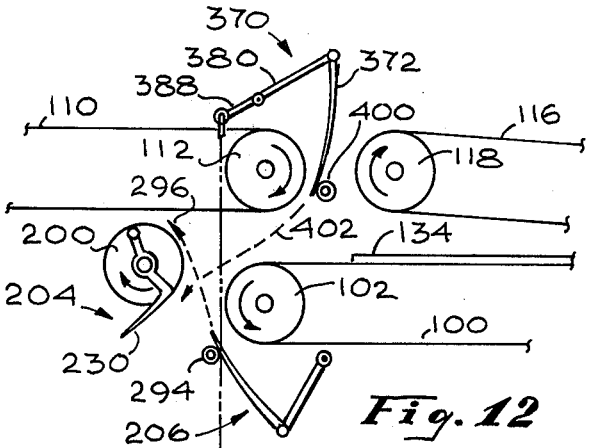
FIG. 12 is a vertical sectional view, similar to FIG. 1, showing a first variation employing an article driver assembly.
Figure 14:
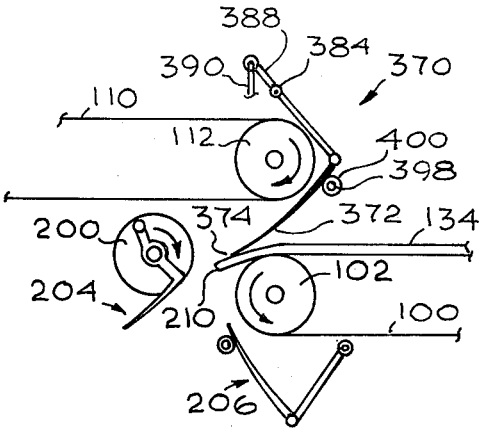
FIG. 14 is a vertical sectional view, showing advancing of the driver blade to drive the article into the added cross folder.

FIG. 12 illustrates the driver assembly 370 in its normal, retracted position. Actuation of the driver assembly 370 occurs after the roller 200 has been reversed to clockwise rotation by closing of the switch 326 and before actuation of the knife assembly 206 by closing of the switch 298. FIG. 14 illustrates the blade 372 of the driver assembly 370 fully advanced along the path 402 such that the blade leading edge 374 drives or pushes the leading portion of the article 134 downwardly, thereby assisting the downwardly diverting action of the roller 200.

Figure 15:
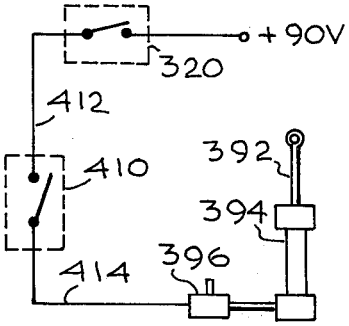
FIG. 15 is a partial schematic drawing showing controls of the article driver.

Circuitry for actuating the driver assembly 370 is illustrated schematically in FIG. 15. A microswitch 410, which may, for example, be positioned to be contacted by the leading edge 210 of the article 134 (in a manner not shown) is armed, via a line 412, by closing of the selector switch 320. Closing of the switch 410 operates the control valve 396 via a line 414. This causes advancement of the cylinder shaft 392 to advance the blade 372 along the path 402.

VARIATION OF FIGS. 16–19

FIGS. 16–19 illustrate a second variation in which a second ramp assembly 420 is employed to guide articles from the delivery belt 100 downwardly into the added cross folder. Such second ramp eliminates the need that the roller 200 be reversible, since the roller, when the added cross folder is used, is shielded by portions of the second ramp assembly. Thus some apparatus simplification may be affected, the electric clutches 224 and 226 not being required and the roller 200 being continually driven in a counterclockwise direction (direction of arrow H, FIGS. 16 and 18) by direct connection to the sprocket 218.

Figure 16:
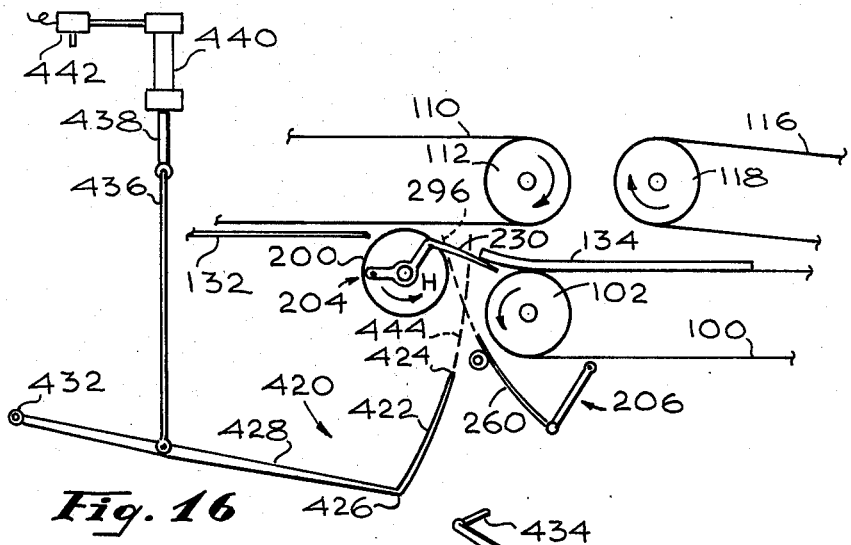
FIG. 16 is a vertical sectional view, similar to FIG. 1, showing a second variation employing an additional ramp assembly.
Figure 17:
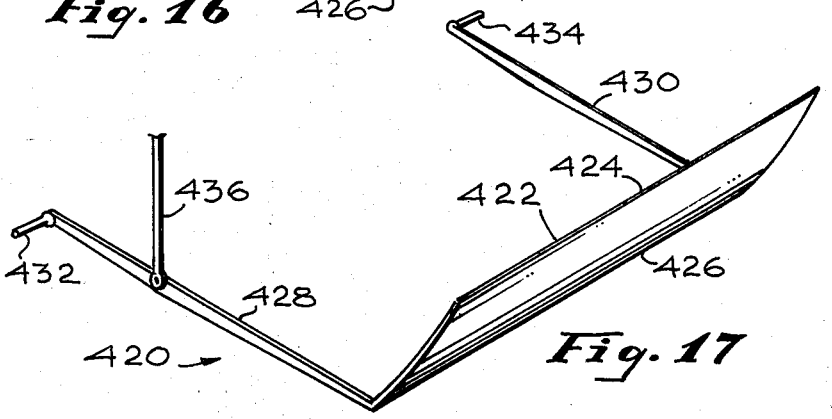
FIG. 17 is a perspective view showing major portions of the additional ramp assembly.
Figure 19:
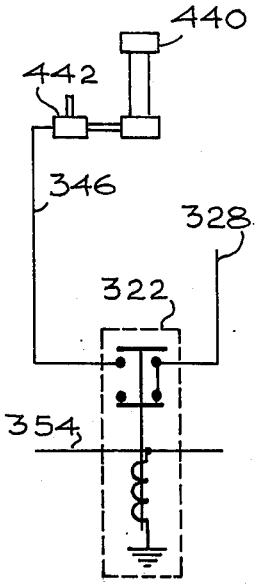
FIG. 19 is a partial schematic drawing, showing controls of the additional ramp assembly.
Figure 18:
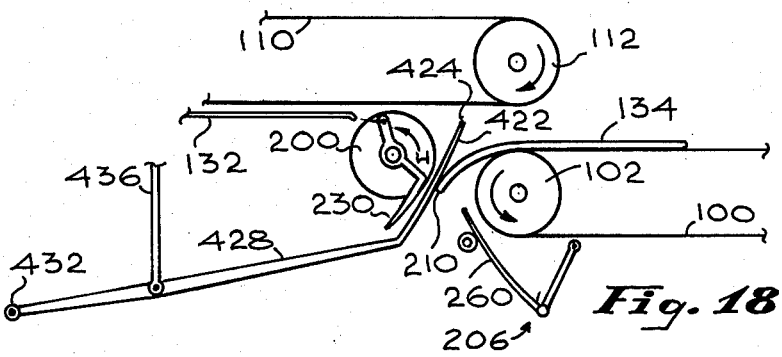
FIG. 18 is a vertical sectional view, showing the additional ramp advanced to deflect articles into the added cross folder.

The second ramp assembly 420 is substantially similar to the added knife assembly 206 and, as best seen in FIGS. 16 and 17, comprises an elongate, slightly curved blade 422 having an upper edge 424 and a bottom edge 426. One end of an elongate first arm 428 is fixed to the lower left-hand (as seen in FIG. 17) corner of the blade 422 at about a right angle, and one end of a similar, parallel second arm 430 is fixed to the right-hand lower corner of the blade. Pins 432 and 434, respectively, pivotally mount other ends of the arms 428 and 430 to the machine walls. The lower end of a generally vertical push rod 436 is pivotally connected to the arm 428 comparatively near the pivot pin 432. The upper end of the rod 436 is connected to a shaft 438 of a pneumatic cylinder 440. A control valve 442, connected to the cylinder 440, controls actuation thereof.

When the selector switch 320 is in the bypass mode and, as described before, the ramp plate 230 is raised to bridge the rollers 102 and 200, and thereby deliver articles 134 directly to the receiving belt 110 and the flippers 132, the second ramp assembly 420 is in a normal, retracted condition. Rotation of the roller 200 is in the counterclockwise direction of arrow H.

Again, as previously described, closing of the switch 320 lowers the ramp plate 230 and arms the switches 298 and 326 (FIG. 4). Actuation of the switch 326 by the first knife arm 128, instead of causing reversed, clockwise rotation of the roller 200, now causes (via the relay 322, FIG. 19) energizing of the control valve 422 with consequent advancement of the blade 422 along a path 444 (FIG. 16), which is upwardly between the rollers 102 and 200 and which intercepts the path 296 of the knife blade 260. The second ramp is momentarily maintained in its extended condition, with the blade edge 424 adjacent the lower portion of the belt 110 (FIG. 18) by the relay 324, latching in the relay 322, in the same manner that clockwise rotation of the roller 200 was previously maintained.

Subsequent momentary closing of the switch 298 by the article 134 unlatches the relay 322 and deenergizes the control valve 442, causing retraction of the second ramp blade 422 to its initial position and also causing advancement of the added knife assembly 206 (as previously described). A delay element (not shown) may be added in the line 352 to the control valve 284 to delay operation of the added knife assembly 206 a short time to assure the blade 422 of the second ramp assembly 420 is clear of the path 296 before the blade 260 is advanced therealong.

Figure 20:
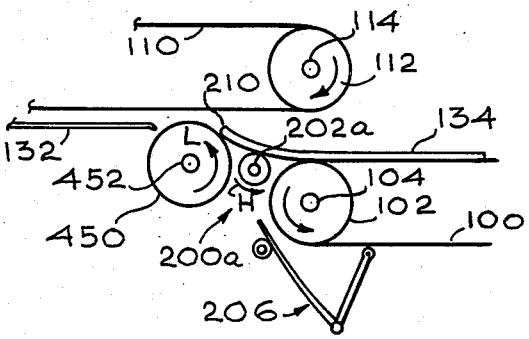
FIG. 20 is a vertical sectional view, similar to FIG. 1, showing a third variation employing an added, counterclockwise rotating roller.
Figure 21:
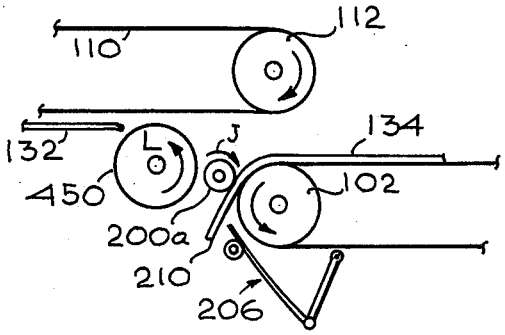
FIG. 21 is a vertical sectional view showing operation of the third variation.

VARIATION OF FIGS. 20 and 21

A third variation, illustrated in FIGS. 20 and 21, is generally similar to the preferred embodiment previously described, except for addition of a roller 450, fixed to a shaft 452 which is continuously driven, during operation of the machine, in the counterclockwise direction of arrow L by drive means (not shown), for example by connection to the shaft 104 of the first roller 102.

Comparing FIGS. 20 and 21 to FIG. 1, the roller 450, which is approximately the size and the diameter of the roller 200, is positioned substantially in the position occupied by the preferred embodiment roller 200. A reversible roller **200*a* in the variation now described is smaller in diameter than the roller 200 and is positioned on a shaft 202*a* intermediate the rollers 450 and 102 such that it nearly fills the gap between such two rollers The shaft 202*a* is interconnected with the rollers 102 and 112 in the manner described for the shaft 202, and hence is reversed in the manner previously described. The smaller diameter roller 200*a* serves combined functions previously performed by the roller 200 and the ramp assembly 204**.

Operation of this third variation is the same as previously described for the preferred embodiment, except that there is no ramp operation. Otherwise, referring both to FIGS. 4 and 20, when the selector switch 320 is in the bypass position, the roller **200*a* is rotated in the counterclockwise direction (arrow H) to divert the leading edge 210 of the article 134 upwardly and rearwardly to the receiving belt 110 and, in this variation, also to the continuously counterclockwise rotating roller 450**.

Placing the switch 320 in the actuate or double fold position arms the switches 298 and 326. The switch 326, when actuated by the first knife arm 128, causes reversing of the roller **200*a* to clockwise rotation, the direction of arrow J of FIG. 21, to cause downward deflection of the leading edge 210. Operation of the added cross folder thereafter is as previously described. It is to be appreciated, however, that a ramp assembly similar to the ramp 204 may still be employed, and that the driver assembly 370 of the first variation described above and/or the second ramp assembly 420** of the second variation described above may also be applied to this variation.

Although there have been described above specific arrangements of double fold automatic folding apparatus in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. In combination with a machine for folding a sequence of articles and having an actuatable article folding knife, an article delivering conveyor belt driven by a first roller rotated in a first direction, an article receiving conveyor belt positioned in receiving relationship with respect to said delivering belt and driven by a second roller rotated in a second direction, said second roller being disposed generally above said first roller, and a receiving element disposed generally beneath and adjacent to said receiving belt, an apparatus for selectively making an additional fold in articles sequentially delivered by said delivering belt, which comprises:

a. an added roller,
said added roller being rotatable about a longitudinal axis thereof and being disposed parallel and adjacent to said first roller in a position to intercept leading edges of articles delivered by said delivering belt;

b. drive means connected to said added roller for causing said added roller to be rotated in either of said first and second directions;

c. an added article folding knife means, said knife means including a blade having an article contacting edge;

d. restraining means for causing said blade to move along a predetermined path, portions of which extend between said first and said added rollers and toward said receiving belt;

e. actuating means connected to said added folding knife means for causing movement of said blade along said path; and f. control means coooperating with said drive means and said actuating means for causing, in sequence,
1. said added roller to be rotating in said second direction when said leading edge of an article from said delivering belt contacts said periphery thereof, whereby to cause said leading edge to be deflected from its initial path of travel, away from said receiving belt and toward said added knife means,
2. said blade to be advanced across said path when a predetermined portion of said article has passed said added roller, whereby said edge of said blade is caused to contact a proximate portion of said article and advance said contacted portion toward said added roller to cause the additional folding of said article back upon itself,
3. said added roller to reverse and be again rotating in said first direction when said contacted portion of said article advanced by said blade contacts the periphery thereof, whereby the newly-folded portion of said article is carried around portions of said added roller towards said receiving belt, and
4. said added blade to be retracted in its path as said newly-folded portion is picked up by said receiving belt and said added roller.

2. The invention as claimed in claim 1, including diverting means for causing said articles being delivered by said delivering belt to advance directly towards said receiving belt without receiving an added fold.

3. The invention as claimed in claim 2, wherein said diverting means includes a movable diverting element disposed intermediate said first and said added rollers, and means for selectively causing movement of said element between a first position wherein said element assists said added roller in diverting said leading edge of said articles towards said added knife means and a second position wherein said diverting element diverts said leading edge of said articles across said added roller towards said receiving belt, said means also causing said added roller to rotate in said second direction when said diverting element is in said second position.

4. The invention as claimed in claim 1, including guide means for supporting said portions of said articles when said articles are deflected to receive an additional fold.

5. The invention as claimed in claim 1, wherein said drive means includes clutch means for selectively driving said added roller from either of said first and second rollers.

6. The invention as claimed in claim 1, wherein said control means is responsive to operation of said first-mentioned article folding knife of said machine.

7. The invention as claimed in claim 1, including drive means responsive to said control means for assisting said added roller in deflecting the leading edge of said articles towards said added knife means.

8. The invention as claimed in claim 7, wherein said drive means includes second added knife means, including a second blade having an article contacting edge, said second blade being selectively movable along a path of motion between said first and said added rollers, whereby to assist diverting of said articles towards said added knife means.

9. Apparatus for performing at least two sequential operations on a relatively flat, foldable article, comprising in combination:

a. first folding means for making a first linear fold in the relatively flat article;

b. first conveying means for conveying the once-folded relatively flat article;

c. selectively operable diverting means for engaging a leading edge of the article from the conveying means and directing it downwardly, the diverting means including a selectively movable plate and a selectively rotatable, reversible roller positioned to uniformly engage the leading edge, both the roller and the plate being independent of the conveying means;

d. second folding means for selectively engaging the diverted, folded article and for making a second linear fold therein;

e. second conveying means for engaging and conveying the folded article from the roller and second folding means; and f. control means for rotatably driving the roller selectively in one of two rotational directions, and for selectively moving the plate in coordinated relationship to the selected rotational direction of the roller.

10. The apparatus of claim 9 wherein the second conveying means comprises a single conveying belt positioned above the roller and adapted to engage the folded article on the lower side of the belt.

11. The apparatus of claim 10 further comprising guide means for guiding the relatively flat foldable article while the diverting means is engaging and directing downwardly the leading edge, and wherein the control means includes a switch positioned on said guide means, the switch being operable by engagement with the leading edge of the article to actuate the second folding means and change the rotational direction of the roller.

12. The apparatus of claim 7, wherein the control means further includes actuating means for moving the plate between a first position and a second position, the actuating means being responsive to the control means whereby the plate is in a first position when the control means drives the roller in a first of the two rotational directions, and the plate is in a second position when the control means drives the roller in the second of the two rotational directions, whereby when the plate is in the first position, the leading edge of the article is deflected downwardly relative to the machine apparatus, and whereby when the plate is in the second position, the leading edge is urged away from the second folding means.

13. The apparatus of claim 9 further comprising pushing means including a second movable part, for engaging the leading edge and urging it downwardly prior to engagement of the leading edge by the first plate and the roller, the pushing means being responsive to the control means whereby the pushing means is selectively operable only when the control means drives the roller in the first of the two rotational directions, and whereby during the driving of the roller in the second of the two rotational directions, the relatively flat foldable article is diverted from the selectively movable first plate and the pushing means.

14. The apparatus of claim 9 wherein the diverting means is operable to engage and direct the leading edge first downwardly and into engagement with the second folding means, and thereafter to engage and direct the twice-folded article into the second conveyor means.

15. The apparatus of claim 14 wherein the control means is operable to drive the roller in the first of the two rotational directions simultaneously with the first engaging and directing by said diverting means, and wherein the control means is operable to drive the roller in the second of the two rotational directions concurrently with the directing of the twice-folded article into the second conveying means.

16. The apparatus of claim 14 further comprising in combination pushing means including a second plate for engaging the leading edge and directing the leading edge downwardly, said pushing means being selectively operable in response to the control means whereby during operation, engagement and directing downwardly by the pushing means the control means is operable to drive the roller in the second of the two rotational directions.

17. Apparatus capable of performing at least two sequential operations on a relatively flat, foldable article, comprising in combination:

a. first folding means for making a first linear fold in a relatively flat article;

b. first conveying means for conveying the once-folded relatively flat article from the first folding means toward a second conveying means;

c. selectively operable diverting means for engaging and directing downwardly a leading edge of the article, the diverting means including a first roller positioned to uniformly engage the leading edge and direct the article to the second conveying means and a second roller having an axis parallel to the first roller positioned between the first roller and the first conveying means and driven with a constant speed ratio to the first roller, the second roller being selectively reversible in rotation and positioned to engage the leading edge of the foldable article prior to engagement of the foldable article by the first roller;

d. second conveying means separate from the first conveying means for conveying the folded article out of the apparatus;

e. second folding means for selectively engaging the folded article and performing a second folding operation; and f. control means for driving the first roller in a first rotational direction to advance the foldable article in contact therewith in the same direction as the first conveying means;

the control means being operable to rotate the second roller selectively in a first direction to divert the leading edge of the foldable article downwardly between the second roller and the first conveying means for engagement by the second folding means, and to drive the second roller at the same peripheral speed as the first roller to engage the twice folded article between the first and second rollers and thereby direct it toward the second conveying means; the control means also being selectively operable to drive the second roller in the opposite rotational direction in order to urge the article when once folded toward the first roller and the second conveying means, thereby bypassing the second folding operation.

18. The apparatus of claim 17 wherein the second conveying means comprises a single conveying belt positioned above the first roller for engaging the folded article on the lower side of the conveying belt.

19. The apparatus of claim 17 further comprising a plate selectively movable by the control means and having a transverse edge adapted to engage the relatively flat, once-folded article transversely upon actuation by the control means to make a second linear fold in the article and move the twice-folded article into engagement by and between the first and second rollers.

20. The machine apparatus of claim 17 wherein the first conveying means includes a third roller having an axis parallel to the first and second rollers, and means for driving the third roller at the same peripheral speed as the second roller, the third roller being positioned in close proximity to the second roller so that when the second roller is rotated in the first rotational direction, the relatively flat, folded article is engaged between the second and third rollers and diverted downwardly.

* * * * *